US007604187B1

(12) United States Patent
Lo

(10) Patent No.: US 7,604,187 B1
(45) Date of Patent: Oct. 20, 2009

(54) FOOT-DRIVEN DEVICE FOR DISPLACING A PAPER SHREDDER BIN

(76) Inventor: Emily Lo, No. 18, Lane 20, Hsin Feng Street, Hsin Chuang City, Taipei Shien (TW)

( * ) Notice: Subject to any disclaimer, the term of this patent is extended or adjusted under 35 U.S.C. 154(b) by 207 days.

(21) Appl. No.: 11/504,792

(22) Filed: Aug. 14, 2006

(51) Int. Cl.
*B02B 7/02* (2006.01)
*B02C 23/00* (2006.01)

(52) U.S. Cl. ..... 241/100; 241/236; 220/908

(58) Field of Classification Search ..... 241/100, 241/236; 220/908, 263, 908.1
See application file for complete search history.

(56) References Cited

U.S. PATENT DOCUMENTS 3,008,604 A * 11/1961 Garner ..... 220/87.1
5,269,473 A * 12/1993 Strohmeyer et al. ..... 241/100
5,372,271 A * 12/1994 Miller et al. ..... 220/263
6,010,024 A * 1/2000 Wang ..... 220/23.87
6,962,301 B1 * 11/2005 Chang ..... 241/100

* cited by examiner

*Primary Examiner*—Bena Miller
(74) *Attorney, Agent, or Firm*—Pro-Techtor Intn'l Services; Ralph H. Willgohs

(57) ABSTRACT

The present invention provides a foot-driven device for displacing a paper shredder bin, and is a separable paper shredder bin structured from an outer frame and an inner bin. A front edge of a bottom portion of the outer frame is provided with a foot pedal. The inner bin is caused to lean outward when a user steps on the foot pedal to facilitate throwing waste into the inner bin.

1 Claim, 4 Drawing Sheets

FOOT-DRIVEN DEVICE FOR DISPLACING A PAPER SHREDDER BIN

BACKGROUND OF THE INVENTION (a) Field of the Invention The present invention relates to a foot-driven pedal for displacing an inner bin from a paper shredder bin.

(b) Description of the Prior Art

A paper shredder bin in a lower portion of prior art paper shredders is only able to hold general paper, and method to remove the paper shredder bin involves the need to first remove the upper paper shredder, which is considerably troublesome, and thus does not provide functional use as a wastebin.

SUMMARY OF THE INVENTION

A primary objective of the present invention is to provide a foot-driven device for displacing an inner bin from a paper shredder bin that enables a user to lightly step on a foot pedal to displace an inner bin of a paper shredder bin to facilitate throwing waste therein.

To enable a further understanding of said objectives and the technological methods of the invention herein, brief description of the drawings is provided below followed by detailed description of the preferred embodiments.

DETAILED DESCRIPTION OF THE PREFERRED EMBODIMENTS

Figure 1:
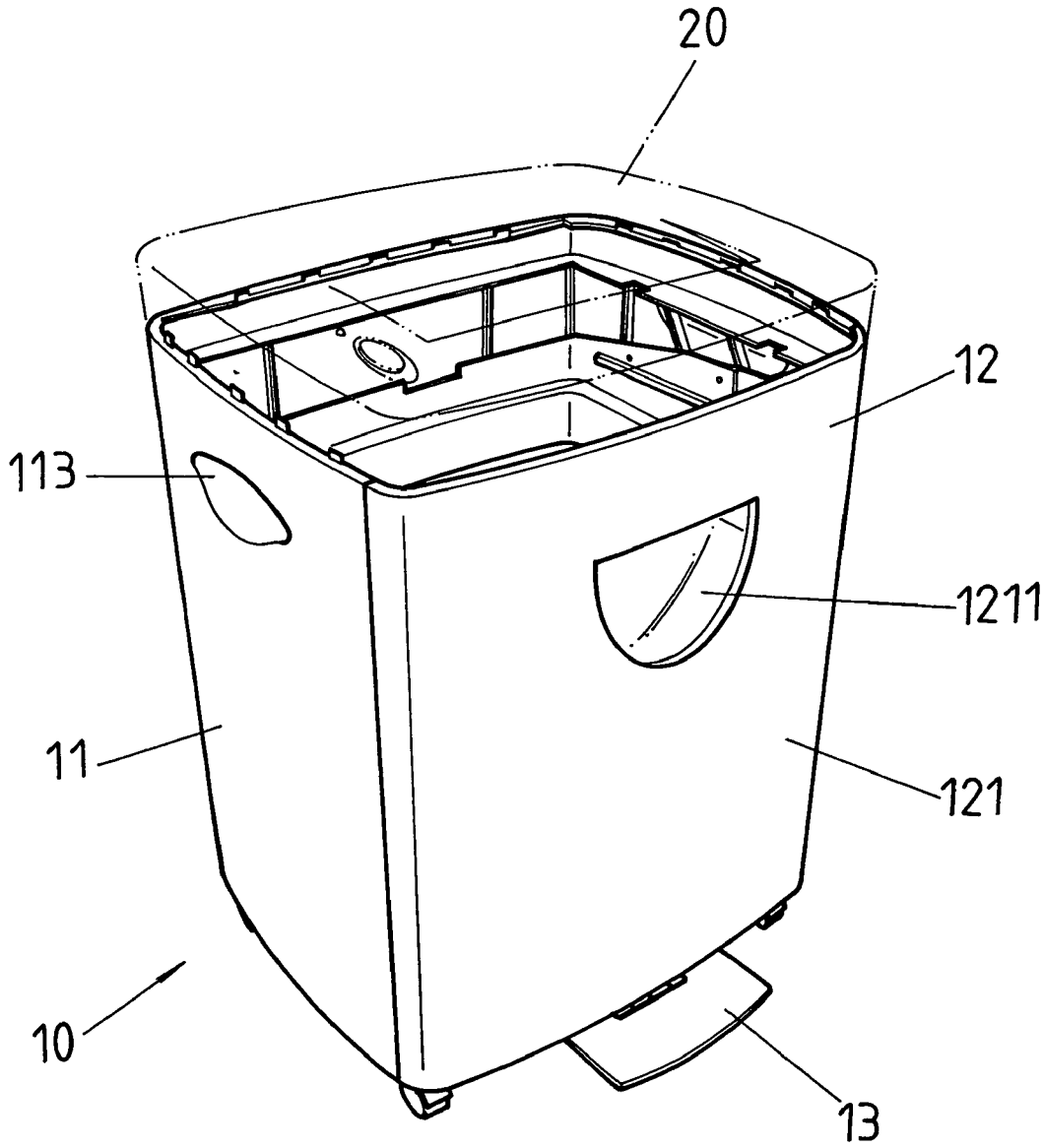
FIG. 1 shows an external view according to the present invention.
Figure 2:
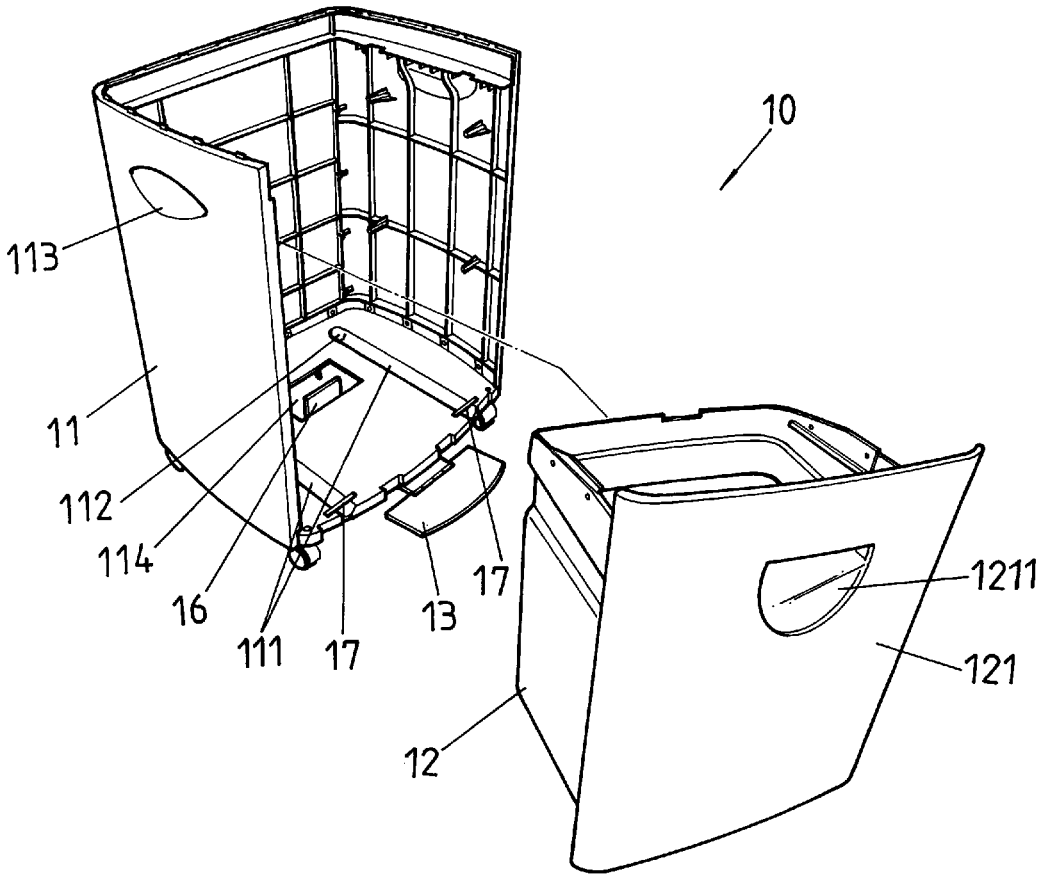
FIG. 2 shows an exploded view according to the present invention.
Figure 3:
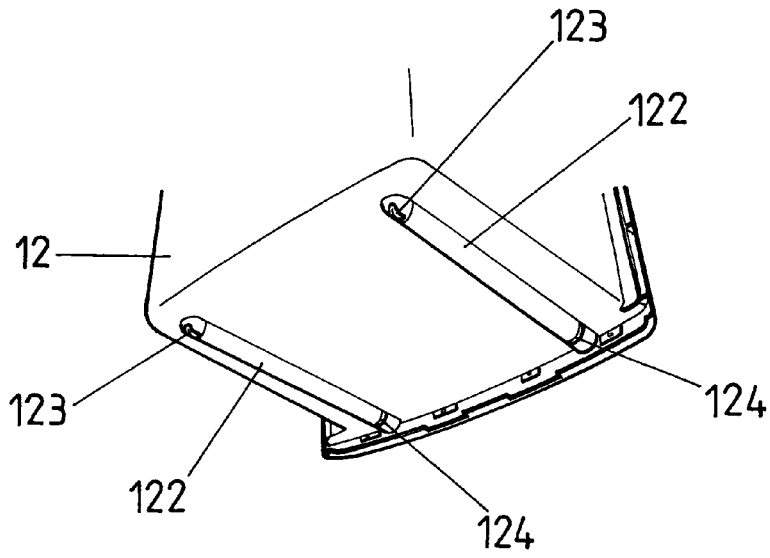
FIG. 3 shows a partial structural view of an inner bin according to the present invention.

Referring to FIGS. 1 and 2, which show a paper shredder bin 10 of the present invention, on top of which is disposed a paper shredder 20. The paper shredder bin 10 is structured to comprise an outer frame 11 and an inner bin 12. A front side and a top end of the outer frame 11 are open ended, and two straight slide grooves 111 are defined on an upper side of a bottom portion of the outer frame 11. A position fixing hole 112 is defined in an inner side of each of the slide grooves 111. The inner bin 12 is an open top end bucket, a front portion of which is provided with a front panel 121, and a bottom portion of the inner bin 12 is provided with two straight slide tracks 122 (see FIG. 3). A slide wheel 123 is located at an inner edge of each of the slide tracks 122, thereby enabling the slide tracks 122 of the inner bin 12 to slide into the respective slide grooves 111 of the outer frame 11. Moreover, the slide wheels 123 slide within the slide grooves 111 and are able to respectively lodge within the position fixing holes 112 of the inner sides of the slide grooves 111, thereby fixing position of the inner bin 12. The front panel 121 of the inner bin 12 and the outer frame 11 form the single-side open ended paper shredder bin 10 when the inner bin 12 is completely slid into the outer frame 11. The front panel 121 of the inner bin 12 is provided with a window 1211, which enables a user to detect amount of shredded paper within the inner bin 12. Furthermore, top ends of two sides of the outer frame 11 are respectively provided with an arc-shaped indentation 113, thereby facilitating lifting of the paper shredder bin 10 with two hands.

Figure 4:
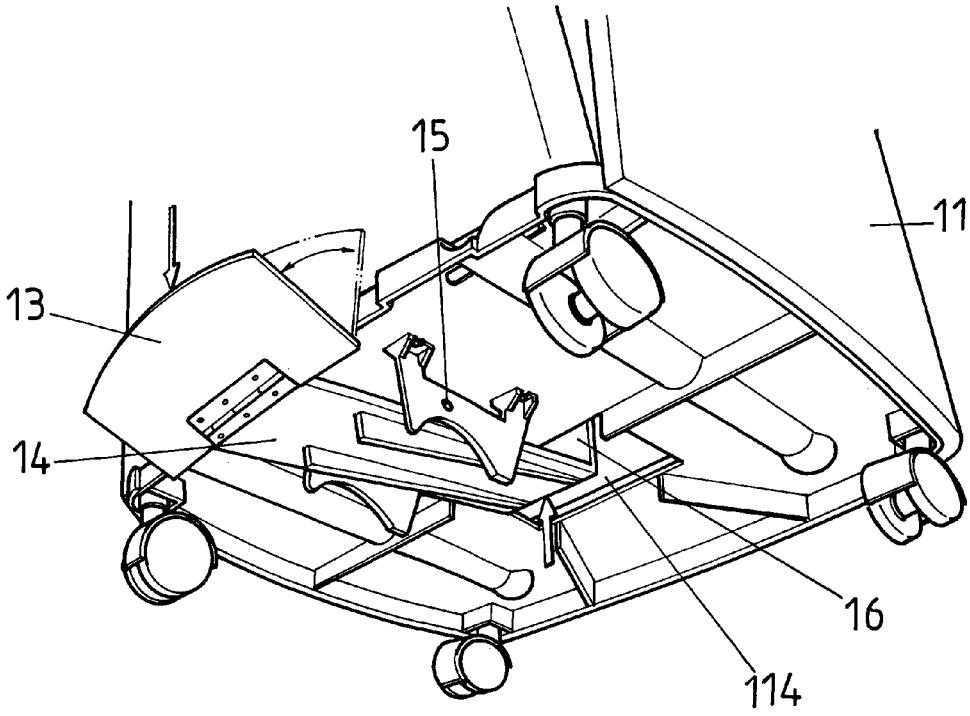
FIG. 4 shows a partial structural view of an outer frame according to the present invention.
Figure 5:
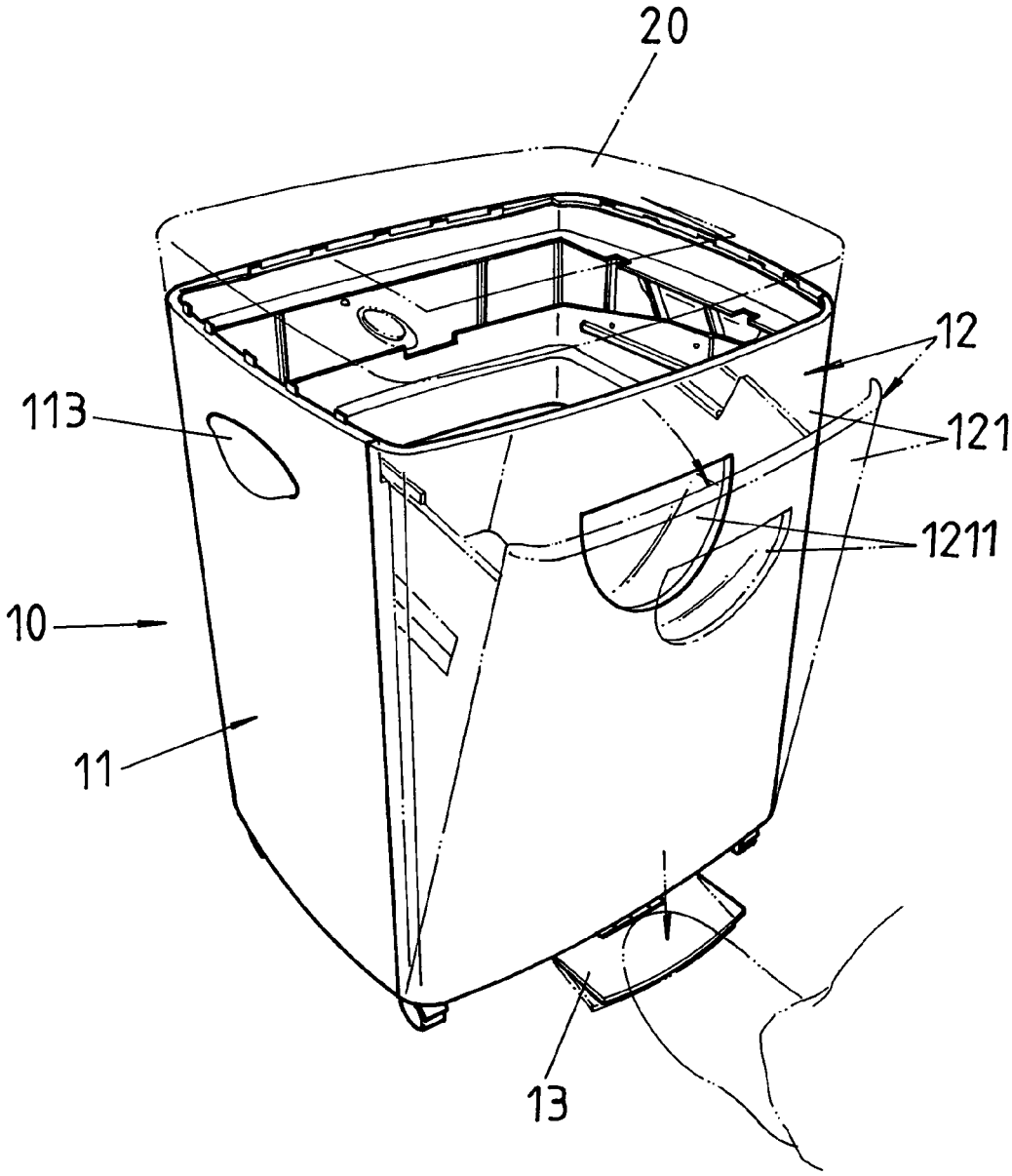
FIG. 5 shows a schematic view of an embodiment according to the present invention.

Referring to FIG. 4, the present invention is characterized in that a foot pedal 13 is installed at a front edge of the bottom portion of the outer frame 11 and pin connected to a connecting board 14. The connecting board 14 is supportedly disposed on a shaft 15 to form a seesaw board structure, and another end of the connecting board 14 is pin connected to a top board 16, moreover, the vertical top board 16 extends out an aperture 114 of the outer frame 11. When the inner bin 12 is disposed within the outer frame 11, the bottom portion of the inner bin 12 presses the top board 16 downward, which simultaneously actuates the connecting board 14, thereby causing the foot pedal 13 to assume a horizontal state. Referring to FIG. 5, when a user steps on the foot pedal 13, the connecting board 14 drives the top board 16 upward about the shaft 15 as center, thereby causing the connecting board 16 to abut against the inner bin 12, whereupon the inner bin 12 leans outward to facilitate throwing waste therein. Moreover, the inner bin 12 returns to its original state as soon as the user releases his foot from the foot pedal 13.

Referring to FIG. 2, a cross bar 17 is located on a front edge of each of the two slide grooves 111 of the outer frame 11, and the cross bars 17 are able to respectively lodge into embed holes 124 of two sides of a front edge of the inner bin 12, thereby preventing the inner bin 12 from coming away from the outer frame 11.

In conclusion, the inner bin 12 is caused to lean outward when a user steps on the foot pedal 13 disposed at the front side of the paper shredder bin 10 of the present invention, thereby facilitating throwing waste therein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A foot-driven device for displacing a paper shredder bin, comprising: an outer frame, a front side and a top end of which are open ended, a front edge of a bottom portion of the outer frame is provided with a foot pedal that is pin connected to a connecting board; the connecting board is supportedly disposed on a shaft, and another end of the connecting board is pin connected to a top board, moreover, the top board extends out an aperture of the outer frame; an inner bin, a top end of which is open ended, and is disposed within the outer frame;

whereby a user steps on the foot pedal to cause the top board of the outer frame to abut against a bottom portion of the inner bin, thereby causing the inner bin to lean outward to facilitate throwing waste into the inner bin;

wherein two sides of a front edge of the outer frame are provided with cross bars; and two sides of a front edge of a bottom portion of the inner bin are provided with embed holes, the cross bars of the outer frame lodge within the embed holes of the inner bin, thereby preventing the inner bin from coming away from the outer frame.

* * * * *